United States Patent [19]

Nakamura et al.

[11] Patent Number: 4,839,257

[45] Date of Patent: Jun. 13, 1989

[54] COLOR DIFFUSION TRANSFER PHOTOGRAPHIC FILM UNIT

[75] Inventors: Shigeru Nakamura; Minoru Minoda; Keisuke Shiba, all of Kanagawa, Japan

[73] Assignee: Fuji Photo Film Co., Ltd., Kanagawa, Japan

[21] Appl. No.: 111,827

[22] Filed: Oct. 23, 1987

[30] Foreign Application Priority Data

| | | | |
|---|---|---|---|
| Oct. 23, 1986 | [JP] | Japan | 252685/86 |
| Oct. 27, 1986 | [JP] | Japan | 254879/86 |
| Sep. 16, 1987 | [JP] | Japan | 231374/87 |
| Sep. 16, 1987 | [JP] | Japan | 231375/87 |

[51] Int. Cl.[4] ..... G03C 5/54

[52] U.S. Cl. ..... 430/207; 430/212; 430/215; 430/220; 430/236; 430/237

[58] Field of Search ..... 430/207, 212, 215, 220, 430/25.9, 236

[56] References Cited

U.S. PATENT DOCUMENTS

| | | | |
|---|---|---|---|
| 3,445,228 | 5/1969 | Beavers et al. | 430/220 |
| 3,658,524 | 4/1972 | Piesach | 430/212 |
| 3,730,718 | 5/1973 | Danhauser | 430/220 |
| 4,377,632 | 3/1983 | Pfingston | 430/220 |
| 4,401,746 | 8/1983 | Pfingston | 430/215 |
| 4,459,346 | 7/1984 | Bishop et al. | 430/236 |
| 4,499,174 | 2/1985 | Bishop et al. | 430/220 |
| 4,606,992 | 8/1986 | Bishop | 430/220 |

OTHER PUBLICATIONS

"Image Transfer Material", *Research Disclosure,* No. 15513, Mar. 1977.

*Primary Examiner*—Richard L. Schilling

*Attorney, Agent, or Firm*—Sughrue, Mion, Zinn, Macpeak, and Seas

[57] ABSTRACT

A color diffusion transfer photographic film unit and a method for forming image therewith which comprises a photosensitive sheet comprising a light-reflective support having disposed thereon in order outwardly from the support (a) a layer having neutralizing function, (b) a dye image-receiving layer, (c) a separating layer and (d) at least one light-sensitive emulsion layer comprising a light-sensitive silver halide, the light-sensitive emulsion layer being associated with at least one dye image-forming material; a transparent cover sheet superposed on the outermost layer of the photosensitive sheet; and rupturable storage means for providing a developing solution substantially opaque to light between the light-sensitive emulsion layer and the transparent cover sheet; provided that at least one of the light-reflective support and layer thereon disposed on the side of the light-sensitive emulsion layer opposite the transparent cover sheet is substantially opaque to light.

15 Claims, 1 Drawing Sheet

COLOR DIFFUSION TRANSFER PHOTOGRAPHIC FILM UNIT

FIELD OF THE INVENTION

This invention relates to a color diffusion transfer photographic film unit and, more particularly, to a color diffusion transfer photographic film unit of a unitary type capable of being processed in a bright room, in which the integral film unit is separated after processing and dye images formed are viewed without passing through the support.

BACKGROUND OF THE INVENTION

Conventional color diffusion transfer photographic film units are generally classified into a peel-apart type and a non-peel-apart type.

In the separation type ("peel-apart type") film unit, photosensitive layers and a dye-receiving layer are each formed on a different support and dye images transferred onto the dye image-receiving layer are obtained by superposing the photosensitive element on the dye image-receiving element after imagewise exposure, spreading a processing composition between the elements, and thereafter, separating the image-receiving element from the photosensitive element.

Since the dye images formed in the imagereceiving layer coated on a support can be directly viewed, the reduction of image quality found in non-peel-apart units described below does not occur, and very excellent color reproduction is obtained However, it is inconvenient to superpose the photosensitive element and the image-receiving element in the camera, and in handling the processed film the alkaline processing liquid after separation is sticky and is liable to stick to surrounding materials.

In the non-peel-apart type film unit, a dye image-receiving layer and silver halide emulsion layers are formed between a transparent support and another support, and the dye image-receiving layer and the silver halide emulsion layers can be formed on the same transparent support or each formed on a different support.

In the former case, a white reflective layer is formed between the image-receiving layer and the silver halide emulsion layer and in the latter case, a white pigment is incorporated in a processing composition which is spread between the image-receiving layer and the silver halide photographic emulsion layers for viewing the dye images transferred onto the image-receiving layer.

These non-peel-apart type film units can be very easily handled without the inconvenience in handling caused by stickiness of the processing liquid after separation and superposing the film sheets in the camera. However, the color images formed are viewed through a transparent support in this type, which unavoidably reduces the image quality of color images, by the reduction in color saturation caused by surface reflection, the insufficiency of whiteness in background areas caused by the deficiency in reflectance of the white reflection layer, etc. Furthermore, silver-halide emulsion layers, a pod for processing liquid, a cover sheet, etc., remain in the color print after processing without being separated, so that the thickness of the color print is inconveniently thicker.

Separation type color diffusion transfer photographic materials are used in various fields such as, for example, ID cards, certificates, etc., because of their simplicity, quickness, and high image quality. In these cases, it is required to coat the back surface of each color print with adhesives after processing and stick it to a proper member, such as sheet, etc., and a convenient method for simplifying such a troublesome post treatment is desired.

Techniques for removing processed silver halide emulsion layer(s), a cover sheet, etc., using a separating layer were disclosed but such conventional techniques could not provide excellent handling qualities and color images having excellent quality.

These conventional techniques are described, for example, in U.S. Pat. Nos. 3,730,718, 4,499,174 and 4,459,349, which disclose a technique of forming, in sequence, an image-receiving layer, a separating layer, and photosensitive layer(s) on a support and, after processing, separating unnecessary portions such as photosensitive layer(s), processing liquid, cover sheet, etc., for reducing the thickness of the color print obtained after processing, i.e., for reducing undesired thickness in a non-peel-apart unitary type film unit. However, these techniques relate to film units for viewing color images formed in the image-receiving layer through the transparent support and, hence, in these techniques the color prints have insufficient image quality caused by the reduction of color saturation caused by the surface reflection of the transparent support, and also by insufficient whiteness of he white reflection layer.

Also, U.S. Pat. Nos. 4,328,301, 3,658,524, British Pat. No. 641,355, and *Research Disclosure,* No. 16462 (Dec., 1977) disclose techniques of forming, in sequence, a dye image-forming layer, a separating layer, and photosensitive layer(s) on a support (including a paper support) and, after processing, separating the photosensitive layer(s) to provide a color print. However, they do fail to disclose a unitary type film unit capable of being processed from development to stabilization in the film unit. For example, U.S. Pat. No. 4,328,301 discloses a technique of processing the photographic material by immersing it in a processing bath and then separating the photosensitive layer(s) in a wet state. Also, *Research Disclosure,* No. 16462 (Dec., 1977) discloses a technique of developing the photographic material by uniformly spreading a viscous processing liquid on the photosensitive element and then separating the photosensitive layer(s) in water. In other words, the photographic materials disclosed each requires a processing bath for the processing. This is also clear from the fact that the photographic materials do not include a layer having a development stopping function or a neutralizing function. These photographic materials having no neutralizing function cannot provide stable color images without stabilization in a processing bath, and if such processing is performed, the techniques are not instant or convenient.

Furthermore, the material disclosed in *Research Disclosure,* No. 16462 (Dec., 1977) is processed in the dark, and cannot be processed in a bright room.

Also, U.S. Pat. Nos. 3,445,228, 3,227,550, 3,227,552 and British Pat. No. 641,355 disclose the use of a separating layer in a color diffusion transfer photographic material using a color developing agent and U.S. Pat. No. 3,445,228 discussed above discloses an acid neutralizing layer formed between a dye image-receiving layer and a support. However, these techniques use dye image-forming methods that give prints insufficient in quality.

These color image-forming methods use a color developer for forming dyes, but the color developing agent remains in the dye image-receiving layer to form significant color stains, and a print having clear background cannot be obtained. Furthermore, the abovedescribed U.S. Pat. No. 3,227,550 does not disclose processing under bright room light.

U.S. Pat. No. 4,401,746 discloses a unitary type film unit having, in sequence, a dye image-receiving layer, a separating layer, and photosensitive layer(s) on a support (including a paper support); removing, after processing, unnecessary photosensitive layer(s), processing composition, etc.; and suggests an acid neutralizing layer formed between the support and the dye image-receiving layer. However, the film unit disclosed in the patent must be processed in the dark, and is not an "instant" material that can be easily processed in a bright room.

Also, U.S. Pat. Nos. 3,820,999, 3,220,835, 2,759,825, 2,614,926, 2,543,181 and 3,409,430 disclose techniques of separating unnecessary photosensitive layers using a separating layer after processing, but these techniques relate to black-and-white photographic materials using a silver salt diffusion transfer process.

Furthermore, U.S. Pat. Nos. 4,359,518, 3,674,482 and 4,383,022 disclose the use of a separating layer for additive color process color photographic materials utilizing silver salt diffusion transfer, but the color photographic materials disclosed do not contain a layer having a neutralizing function. Moreover, they cannot be processed in bright room light.

SUMMARY OF THE INVENTION

An object of this invention is, therefore, to provide a novel film unit capable of being processed in a bright room to provide color images of high quality by a separation type color diffusion transfer photographic film unit having the excellent handling qualities of a non-peel-apart type color diffusion transfer photographic film unit.

Another object of this invention is to provide a color diffusion transfer photograph of high quality without stickiness after separation.

A further object of this invention is to provide a diffusion transfer image-forming method capable of giving color images of high quality by processing in a bright room without causing stickiness.

Another object of this invention is to provide a separation type color transfer photographic film unit capable of simply and easily mounting the photographic print obtained.

It has now been discovered that these and other objects of the invention can be attained by a color diffusion transfer photographic film unit composed of a photosensitive element, an alkaline processing composition containing a light-opaque agent, and a transparent cover sheet, the photosensitive element comprising a white support having thereon, in sequence, (a) a layer having a neutralizing function, (b) a dye imagereceiving layer, (c) a separating layer, and (d) at least one silver halide emulsion layer having associated therewith a dye image-forming material, wherein the film unit has a layer having a light-shielding function on the opposite side of the silver halide emulsion layer to the side of spreading the processing composition.

DETAILED DESCRIPTION OF THE INVENTION

Figure 1:
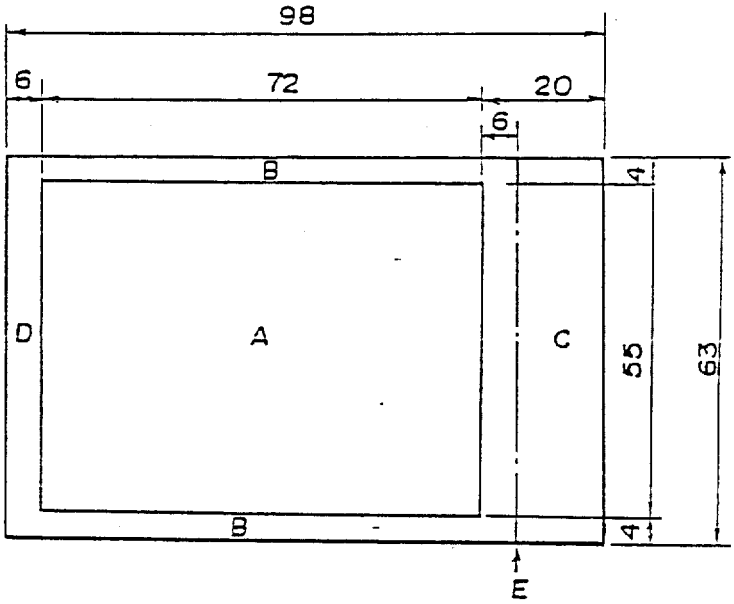
FIG. 1 illustrates the size of the photographic film unit of this invention.

In processing the photographic film unit of this invention, after imagewise exposure, the film is treated using pressure-applying members to uniformly spread the alkaline processing composition in the film unit and to initiate development.

After processing, the portion containing the white support and the dye image-receiving layer is separated from the remaining portion at the sep= =ting layer, and a color print, similar to a conventional color print, without the processed silver halide emulsion layer(s), the pod, the cover sheet, etc., is obtained.

In a specific embodiment of this invention, an adhesive layer having a releasable sheet or paper is formed on the back side (i.e., the opposite side to the side of carrying the dye image-receiving layer) of the white support.

In this embodiment, after imagewise exposing and processing the film unit, the releasable sheet is removed from the back surface of the color print obtained and the color print can be easily mounted a desired member or portion.

According to a preferred embodiment of this invention, the alkaline processing composition containing a light-opaque agent is capable of spreading between the uppermost layer of the photosensitive element and the cover sheet to shield the light-sensitive layers from light transmitted through the transparent support and, further has a layer having a light-shielding function on the side of the silver halide emulsion layer opposite to the side on which the processing-composition is applied.

According to another embodiment of this invention, there is provided a color diffusion transfer image-forming method which comprises imagewise exposing a color diffusion transfer photographic film unit comprising a photosensitive element, an alkaline processing composition containing a light-opaque agent, and a transparent cover sheet, the photosensitive element comprising a white support having thereon, in sequence, at least (a) a layer having a neutralizing function, (b) a dye image-receiving layer, (c) a separating layer, and (d) at least one silver halide emulsion layer having associated therewith a dye image-forming material, the film unit further having a layer having a light-shielding function on the opposite side of the silver halide emulsion layer to the side of spreading the processing composition from the cover sheet side and spreading the processing composition between the uppermost layer of the photosensitive element and the cover sheet.

The present film unit is capable of being processed in bright room light, and provides color prints of high image quality without unnecessary layers that have excellent handling qualities.

According to this invention, by forming a dye image-receiving layer on a white support and forming a layer having a neutralizing function between the dye image-receiving layer and the support, the occurrence of undesirable fog in image formation can be prevented, and also the formation of stain and discoloration of dye images during the storage of color prints can be prevented. Also, by incorporating a layer opaque to light on the side of the photosensitive layer(s) opposite to the side on which the processing composition is spread and also incorporating a light-opaque agent in the processing composition which is spread over the photosensitive layer at processing, it becomes possible to develop the photographic material even under daylight. Furthermore, in this invention, as a practical means for preventing light from reaching the photosensitive layer(s) from the side opposite that on which the processing composition (containing a light-opaque agent) is spread, it is preferred to form a layer containing a light-opaque agent between the photosensitive layer and the support, on the back surface of the white support, and/or in the white support itself. It is particularly preferred to form a layer containing a light-opaque agent on the back surface of the white support (more preferably, such layer is used by incorporating with a layer in which a processing composition is spread to shield light.

Also, in this invention, by forming a separating layer between the photosensitive layer(s) and the dye image-receiving layer, a thin color print of the same form as a conventional color print, i.e., having no processed photosensitive layer(s), pod for processing liquid, etc., can be obtained. In the color print according to the present invention, the dye imagereceiving layer on the reflective support having high whiteness is directly viewed and, hence, the background is clean and the image quality has high color saturation and is excellent.

Now, the parts and layers of the film unit of this invention are explained in greater detail.

(A) Support

The light-reflective support in this invention is a support which is white on at least the side on which the dye image-receiving layer is formed, and any conventional supports having a sufficient whiteness and smoothness can be used in this invention. For example, a polymer film whitened by the addition of a white pigment such as titanium oxide, barium sulfate, zinc oxide, etc., having 0.1 to 0.5 μm of grain size or by the formation of microvoids by stretching, such as whitened films (synthetic papers) composed of polyethylene terephthalate, polystyrene, or polypropylene film formed by conventional, bioxial extruding process and a paper both surfaces of which are laminated with polyethylene, polypropylene, polyethylene terephthalate, etc., each containing titanium white are preferably used. The thickness of the support is from about 50 μm to 350 μm, preferably from about 70 μm to 210 μm, and more preferably from about 80 μm to 150 μm. Also, if necessary, a lightopaque layer may be formed in the support. For example, a support formed by laminating polyethylene containing a light-shielding agent such as carbon black on the back surface of a white support is included in this invention.

As a raw material of carbon black, any type of the materials prepared by the process such as a channel method, a thermal method, a furnace method, etc. disclosed in the literature, Donnet Voet "Carbon Black" Marcel Dekker, Inc., (1976) may be used. A grain size of the carbon black is not specifically limited, and is preferably of 90 to 1,800Å. An amount of a black pigment to be added as a shielding material may be adjusted depending on a sensitivity of a photosensitive material and is preferable of 5 to 10 of an optical density.

(B) Dye Image-Receiving Layer

The dye image-receiving layer for use in this invention is composed of a hydrophilic colloid containing a mordant. The layer may be a single layer or may be composed of two or more layers each containing a mordant having a different mordanting power. These layers are described in Japanese Patent Application (OPI) No. 252551/86 (the term "OPI" as used herein refers to a "published unexamined Japanese Patent Application").

As the mordant, a polymer mordant is preferred. The polymer mordant for use in this invention includes polymers having secondary or tertiary amino groups, polymers having nitrogen-containing heterocyclic moieties, and polymers containing quaternary cation groups, each having a molecular weight of at least about 5,000, and preferably at least about 10,000.

Specific examples of the mordant polymer are vinylpyridine polymers and vinylpyridinium cation polymers disclosed in U.S. Pat. Nos. 2,548,564, 2,484,430, 3,148,061, 3,756,814, etc.; vinylimidazolium cation polymers disclosed in U.S. Pat. No. 4,124,386, etc.; the polymer mordants crosslinkable with gelatin, etc., disclosed in U.S. Pat. Nos. 3,625,694, 3,859,096, 4,128,538, British Pat. No. 1,277,453, etc.; the aqueous sol type mordants disclosed in U.S. Pat. Nos. 3,958,995, 2,721,852, 2,798,063, Japanese Patent Application (OPI) Nos. 115228/79, 145529/79, 126027/79, 155835/79, 17352/81 (U.S. Pat. No. 4,308,335), etc.; the water-insoluble mordants disclosed in U.S. Pat. No. 3,898,088, etc.; the reactive mordants capable of performing covalent bonding with dyes disclosed in U.S. Pat. Nos. 4,168,976, 4,201,840, etc.; and the mordants disclosed in U.S. Pat. Nos. 3,709,960, 3,788,855, 3,642,482, 3,488,706, 3,557,066, 3,271,147, 3,271,148, Japanese Patent Application (OPI) Nos. 30328/78 (U.S. Pat. No. 4,131,469), 155528/78, 125/78 (U.S. Pat. No. 4,154,615), 1024/78 (U.S. Pat. No. 4,142,899), 107835/78, British Pat. No. 2,064,802, etc.

Furthermore, the mordants described in U.S. Pat. Nos. 2,675,316 and 2,882,156 can be used in this invention.

Among the mordants, a mordant which does not easily transfer from a mordant layer to another layer is preferable, for example, a mordant which is capable cross-reacting with a matrix such as gelatine, etc., a water-insoluble mordant, and an aqueous sol type or a latex dispersant type mordant is preferable. The latex dispersant type mordant is most preferable and has a particle size of 0.01 to 2 μm, preferable 0.05 to 0.2 μm.

An amount of the mordant to be coated may be varied depending on a type of mordant, a content of quarternary cation group, a type and amount of dye to be mordanted, a type of binder to be used, and the like, and is 0.5 to 10 g/m$^2$, preferably 1.0 to 5.0 g/m$^2$.

Regarding with a hydrophilic colloid to be used in an image receiving layer, a gelatin, polyvinyl alcohol, polyacrylamide, polyvinyl pyrolidone may be used, and a gelatin is preferably used.

(C) Layer Having a Neutralizing Function

The layer having a neutralizing function ("neutralizing layer") for use in this invention is a layer containing an acidic material in an amount sufficient for neutralizing alkalis from the processing composition and, if necessary, may be a multilayer structure composed of a neutralization speed-controlling layer (timing layer), an adhesion strengthening layer, etc.

As the preferred acidic material which is used for the neutralizing layer, there are materials containing an acid group having a pKa of less than about 9 (or a precursor group providing the acid group by hydrolysis thereof) and as more preferred acidic materials there are higher fatty acids such as oleic acid, etc., as described in U.S. Pat. No. 2,983,606; polymers of acrylic acid, methacrylic acid, or maleic acid, the partial esters thereof, or the acid anhydrides thereof as disclosed in U.S. Pat. No. 3,362,819; copolymers of acrylic acid and acrylic acid esters as disclosed in French Pat. No. 2,290,699; and latex acid polymers as disclosed in U.S. Pat. No. 4,139,383 and *Research Disclosure,* No. 16102 (1977).

Furthermore, the acidic materials disclosed in U.S. Pat. No. 4,088,493, Japanese Patent Application (OPI) Nos. 153739/77 (U.S. Pat. No. 4,149,890), 1023/78, 4540/78, 4541/78 (U.S. Pat. No. 4,149,891), 4542/78, etc., can be used in this invention.

Specific examples of the acidic polymer are copolymers of a vinyl monomer such as ethylene, vinyl acetate, vinyl methyl ether, etc., and maleic anhydride; the n-butyl half esters of the copolymers; a copolymer of butyl acrylate and acrylic acid; cellulose acetate hydrogenphthalate, etc.

The acidic polymer described above can be used as a mixture with a hydrophilic polymer, such as polyacrylamide, polymethylpyrrolidone, polyvinyl alcohol (including partially saponificated products thereof), carboxymethyl cellulose, hydroxymethyl cellulose, hydroxyethyl cellulose, polymethyl vinyl ether, etc. Of these materials, polyvinyl alcohol is preferred.

The coating amount of the acidic polymer is controlled according to the amount of alkali spread over the photosensitive element. The equivalent ratio of the acid polymer to alkali per unit area is preferably from about 0.9 to 2.0. If the amount of acid polymer is too small, the hue of transferred dye images is changed and also stain forms in the background portion, while if the amount is too large, the hue changes and light resistance is reduced. The more preferred equivalent ratio is from about 1.0 to 1.3. If the proportion of the hydrophilic polymer is too large or too small, the quality of photograph is reduced. The weight ratio of the hydrophilic polymer to the acidic polymer is from about 0.1 to 10, and preferably from about 0.3 to 3.0.

The neutralizing layer in this invention may further contain various additives for various purposes. For example, for hardening of the layer, a hardening agent well known in the field may be used or for improving brittleness of the layer, a polyhydric hydroxyl compound such as polyethylene glycol, polypropylene glycol, glycerol, etc., can be added thereto. Furthermore, if necessary, an antioxidant, an optical whitening agent, a dye for bluishing, etc., may be added to the layer.

Timing Layer

A timing layer can be used in combination with the neutralizing layer in this invention. For the timing layer, for example, a polymer capable of reducing alkali permeability, such as gelatin, polyvinyl alcohol, a partial acetal product of polyvinyl alcohol, cellulose acetate, partially hydrolyzed polyvinyl acetate, etc.; a latex polymer capable of increasing the activation energy of alkali permeability, formed by copolymerizing a small amount of a hydrophilic comonomer such as an acrylic acid monomer therewith, etc.; and a polymer having a lactone ring are useful in this invention. In these materials, timing layers using cellulose acetate disclosed in Japanese Patent Application (OPI) No. 136328/79 and U.S. Pat. Nos. 4,267,262, 4,009,030, 4,029,849, etc.; latex polymers formed by copolymerizing a small amount of a hydrophilic comonomer such as acrylic acid therewith disclosed in Japanese Patent Application (OPI) Nos. 128335/79, 69629/81, 6843/82, U.S. Pat. Nos. 4,056,394, 4,061,496, 4,199,362, 4,250,243, 4,256,827, 4,268,604, etc.; polymers having a lactone ring disclosed in U.S. Pat. No. 4,229,516; and the polymers disclosed in Japanese Patent Application (OPI) Nos. 25735/81, 97436/81, 6842/82, European Pat. Nos. 31,957Al, 37,724Al, 48,412$A_1$, etc., are particularly useful.

Furthermore, the polymers described in U.S. Pat. Nos. 3,421,893, 3,455,686, 3,575,701, 3,778,265, 3,785,815, 3,847,615, 4,088,493, 4,123,275, 4,148,653, 4,201,587, 4,288,523, 4,297,431, West German Patent Application (OLS) Nos. 1,622,936, 2,162,277, and *Research Disclosure,* No. 15162, 151 (1976) can be used in this invention.

The timing layer can be a single layer or multilayers.

Also, the timing layers can contain development inhibitors disclosed in U.S. Pat. No. 4,009,029, West German Patent Application (OLS) Nos. 2,913,164 and 3,014,672, Japanese Patent Application (OPI) Nos. 155837/79, 138745/80 (U.S. Pat. No. 4,562,138), etc., and/or hydroquinone precursors disclosed in U.S. Pat. No. 4,201,578, as well as other photographically useful additives or the precursors thereof.

(D) Light-Opaque Layer

In this invention, by completely shielding the photosensitive layer(s) by a light-opaque layer in the photosensitive sheet and a light-opaque processing liquid spread on the photosensitive sheet during processing from external light during development, it is possible to process the film unit under daylight conditions. A layer containing a light-opaque agent may be provided on the back surface of the support or between the silver halide emulsion layer and the support, or a layer containing a light-opaque agent may be formed in the support.

As the light-shielding agent, materials having a light-shielding function may be used but carbon black is preferably used.

As for a raw material of a carbon black, those prepared according to any conventional method such as a channel method, thermal method and furnace method, which are disclosed in Donnet.Voet "Carbon Black" Marcel Dekker, Inc. (1979). A particle size of the carbon black is not specifically limited, however, is preferably 90 to 1,800Å. A graft-carbon black disclosed in Japanese Patent Application (OPI) No. 97142/84 may also be used.

As a binder for coating the light-shielding agent, there are polymers capable of dispersing carbon black, etc., but gelatin is preferably used.

In the light-shielding layer of the present invention, a weight ratio of a black pigment/hydrophilic colloid is preferably 1.5/1 to 0.5/1, most preferably 0.7/1 to 0.3/1. An amount of a block pigment may be adjusted depending on a sensitivity of a photosensitive material which has preferably 5 to 10 of an optical density.

Light-shielding of the photosensitive layer(s) in this invention is accomplished by light-shielding one surface of the photosensitive layer(s) by spreading thereon a processing composition having a light-shielding function and forming a layer containing a light-shielding agent either (a) on the other surface of the photosensitive layer(s), (b) in the white support itself, and/or (c) on the back surface of the light-reflective support (the surface of the side opposite to the side carrying the photosensitive layer(s)). The photosensitive layer(s) may be light-shielded by a combination of layers (a), (b), and (c) described above, even if each single layer is itself insufficient to provide complete light-shielding.

(E) Separating Layer

In this invention, a separating layer is formed between a silver halide emulsion layer associated with a dye image-forming material, and a dye image-forming layer and after processing these layer(s) are separated. Accordingly, the separating layer must adhere to the dye image-receiving layer and the silver halide emulsion layer in an unprocessed state, and must be easily separated after processing.

As materials for the separating layer, those described in Japanese Patent Application (OPI) Nos. 8237/72 (U.S. Pat. No. 3,730,718), 220727/84 (U.S. Pat. No. 4,499,174), 229555/84 (U.S. Pat. No. 4,459,346), 4653/74, 4334/74, 65133/81, 24075/70, U.S. Pat. Nos. 3,220,835, 4,359,518, 2,759,825, 4,401,746, 4,366,227, etc., can be used. One specific example thereof is a water-soluble cellulose derivative (or alkali-soluble cellulose derivative), including, for example, hydroxymethyl cellulose, cellulose acetate biphthalate, plasticized methyl cellulose, ethyl cellulose, cellulose acetate, carboxymethyl cellulose, etc. Other examples include natural polymers such as alginic acid, pectin, gum arabic, etc. Also, various modified gelatins such as acetylated gelatin, phthalated gelatin, etc., can be used. Furthermore, other examples of the materials for the separating layer include water-soluble synthetic polymers such as polyvinyl alcohol, polyacrylate, polymethacrylate, butyl methacrylate, and copolymers of these monomers.

The separating layer may be a single layer or may be composed of plural layers as described in Japanese Patent Application (OPI) Nos. 220727/84, 60642/85, etc.

(F) Photosensitive Layer

In this invention, a photosensitive layer composed of at least one silver halide emulsion layer having associated therewith a dye image-forming material is coated on the above-described separating layer. The dye image-forming material is dissolved in a suitable solvent, dispersed as a fine particle into a hydrophilic colloid such as gelatin, and added in a photosensitive layer. The components of the photosensitive layer are described below.

(1) Dye Image-Forming Material:

The dye image-forming material ("coupler") for use in this invention is a nondiffusible compound releasing a diffusible dye (or a diffusible dye precursor) in relation to silver development, or a nondiffusible compound which becomes diffusible on silver development. These compounds are described, for example, in T. H. James, *The Theory of Photographic Process*, (4th Ed.), Macmillan Publishing Co., Inc. These compounds can be represented by the following formula (I):

$$\text{DYE-Y} \qquad \text{(I)}$$

wherein DYE represents a dye or a precursor thereof and Y represents a moiety modifying the diffusibility of DYE. The compound is generally classified, according to the function of Y, as a negative working compound which becomes diffusible in developed silver portions or a positive working compound which becomes diffusible in undeveloped portions.

Practical examples of negative working compounds are compounds which are oxidized as a result of development and cleaved to release a diffusible dye.

Specific examples of Y for negative working compounds are described in U.S. Pat. Nos. 3,928,312, 3,993,638, 4,076,529, 4,152,153, 4,055,428, 4,053,312, 4,198,235, 4,179,291, 4,149,892, 3,844,785, 3,443,943, 3,751,406, 3,443,939, 3,443,940, 3,628,952, 3,980,479, 4,183,753, 4,142,891, 4,278,750, 4,139,379, 4,218,368, 3,421,964, 4,199,355, 4,199,354, 4,135,929, 4,336,322, 4,139,389, Japanese Patent Application (OPI) Nos. 50736/78, 104343/78 (U.S. Pat. No. 4,198,235), 130122/79 (U.S. Pat. No. 4,179,291), 110827/78 (U.S. Pat. No. 4,139,379), 12642/81, 16131/81, 4043/82, 650/82, 20735/82 (U.S. Pat. No. 4,358,532), 69033/78, 130928/79 (U.S. Pat. No. 4,232,107), 164342/81 (U.S. Pat. No. 4,371,604), 119345/82 (U.S. Pat. No. 4,440,929), etc.

Examples of the particularly preferred groups Y for negative working dye-releasing redox compounds are N-substituted sulfamoyl groups, where the N-substituents are groups derived from aromatic hydrocarbon rings or heterocyclic rings.

Typical examples of groups represented by Y in formula (I) are illustrated below, but the invention is not to be considered as being limited to these groups.

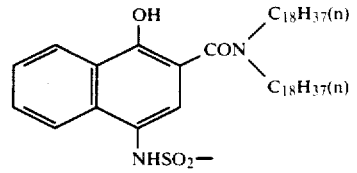

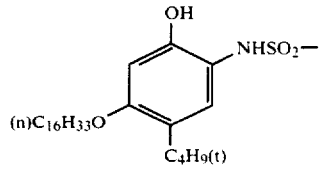

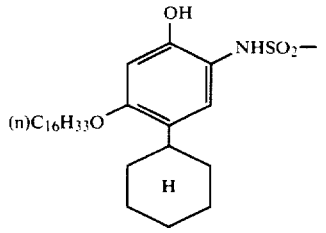

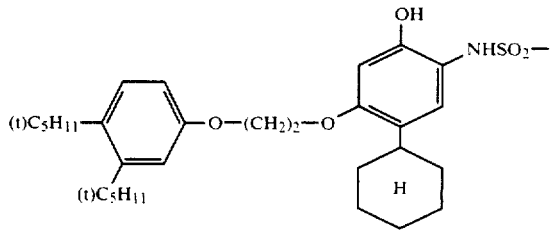

-continued

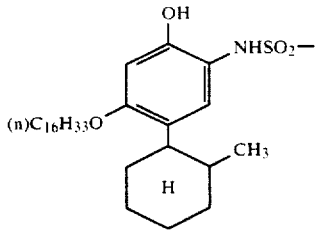

Positive working compounds represented by Y are described in *Angev. Chem. International Edition in English*, 22, 191 (1982).

Practical examples of the positive working compound are compounds (dye developers) which are initially diffusible under alkaline conditions but become nondiffusible by being oxidized at development. Typical examples of Y effective for this type of compound are described in U.S. Pat. No. 2,983,606.

Also, another type of positive working compound is a compound which releases a diffusible dye by self ring closure under alkaline conditions, but substantially does not release dye when it is oxidized upon development. Examples of Y with this function are described in U.S. Pat. Nos. 3,980,479, 3,421,964, 4,199,355, Japanese Patent Application (OPI) Nos. 69033/78, 130927/79, etc.

Also, still another type of the positive working compound is a compound which does not release a dye by itself, but releases a dye when it is reduced. Compounds of this type can be used in combination with an electron donor, whereby a diffusible dye can be imagewise released by the reaction with the imagewise oxidized remaining electron donor. Atomic groups having this function are described in U.S. Pat. Nos. 4,183,753, 4,142,891, 4,278,750, 4,183,379, 4,218,368, 4,356,249, 4,358,525, Japanese Patent Application (OPI) Nos. 110827/78, 130927/79, 164342/81, Kokai Giho 6199/87, and European Patent Application 220,746A2.

Specific examples of dye image-forming materials are illustrated below but the invention is not to be construed as being limited to them.

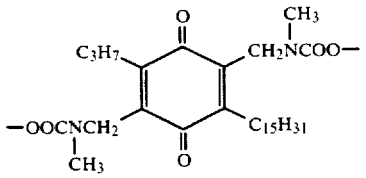

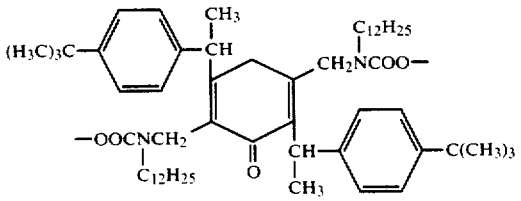

-continued

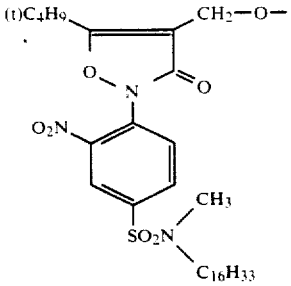

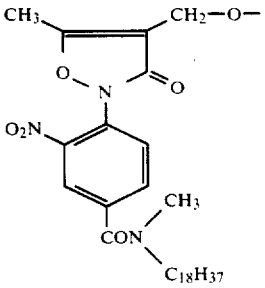

When using the compound of this type, it is preferably used in combination with nondiffusible electron donative compound (well known as an "ED compound") or a precursor thereof. Examples of the ED compound are described, for example, in U.S. Pat. Nos. 4,263,393, 4,278,750, and Japanese Patent Application (OPI) No. 138736/81.

Also, other dye image-forming materials represented by the following formulae can be used:

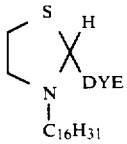

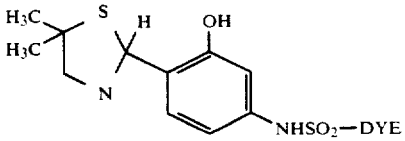

wherein DYE represents a dye or a precursor thereof as described above.

The details of these compounds are described in U.S. Pat. Nos. 3,719,489 and 4,098,783.

Further specific examples of dyes represented by DYE of the above-described formulae are described in the following publications:

Examples of Yellow Dye:

U.S. Pat. Nos. 3,597,200, 3,309,199, 4,013,633, 4,345,028, 4,156,609, 4,139,383, 4,195,992, 4,148,641, 4,148,643, 4,336,322, Japanese Patent Application (OPI) Nos. 114930/76, 71072/81, Research Disclosure, No. 17630 (1978), ibid., No. 16475 (1977).

Examples of Magenta Dye:

U.S. Pat. Nos. 3,453,107, 3,544,545, 3,832,380, 3,931,144, 3,932,308, 3,954,476, 4,233,237, 4,255,509, 4,250,246, 4,142,891, 4,207,104, 4,287,292, Japanese Patent Application (OPI) Nos. 106727/77 (U.S. Pat. No.

4,493,885), 23628/78, 36804/80, 73057/81, 71060/81 and 134/80.

Examples of Cyan Dye:

U.S. Pat. Nos. 3,482,972, 3,929,760, 4,013,635, 4,268,625, 4,171,220, 4,242,435, 4,142,891, 4,195,994, 4,147,544, 4,148,642, British Pat. No. 1,551,138, Japanese Patent Application(OPI) Nos. 99431/79 (U.S. Pat. No. 4,195,993), 8827/77, 47823/78, 143323/78, 71061/81, European Pat. Nos. (EPC) 53,037, 53,040, *Research Disclosure*, No. 17630 (1978), ibid., No. 16475 (1977).

(2) Silver Halide Emulsion

The silver halide emulsion for use in this invention may be a negative working emulsion forming latent images mainly on the surfaces of silver halide grains or an internal latent image type direct positive working emulsion forming latent images in the inside of silver halide grains.

The internal latent image type positive working emulsion includes, for example, a "conversion type" emulsion prepared by utilizing the difference in solubility of silver halide emulsions and a "core/shell type" emulsion prepared by coating a shell of silver halide on at least the photosensitive site of a core grain of silver halide which is doped with a metal ion, chemically sensitized, or subjected to both the treatments.

These emulsions are described in U.S. Pat. Nos. 2,592,250, 3,206,313, 3,761,276, 3,935,014, 3,447,927, 2,497,875, 2,563,785, 3,551,662, 4,395,478 and 4,431,730, British Pat. No. 1,027,146, West German Pat. No. 2,728,108.

Also, when using an internal latent image type direct positive emulsion, it is necessary to provide fogged nuclei on the grain surface by light exposure or using a nucleating agent after imagewise exposure.

Nucleating agents used for this purpose include hydrazines described in U.S. Pat. Nos. 2,563,785 and 2,588,982; hydrazides and hydrazones described in U.S. Pat. No. 3,227,552; heterocyclic quaternary salt compounds described in British Pat. No. 1,283,835, Japanese Patent Application (OPI) No. 69613/77, U.S. Pat. Nos. 3,615,615, 3,719,494, 3,737,738, 4,094,683, 4,115,122; etc., sensitizing dyes having a substituent with nucleating action in the dye molecule; thiourea bonding type acylhydrazine series compounds described in U.S. Pat. Nos. 4,030,925, 4,031,127, 4,245,037, 4,255,511, 4,266,013, 4,276,364, and British Pat. No. 2,012,443; etc., and acylhydrazine series compounds having bonded thereto a heterocyclic group at an adsorption group, such as thioamide rings, triazoles, tetrazoles, etc., described in U.S. Pat. Nos. 4,080,270, 4,278,748, and British Pat. No. 2,011,391B.

In this invention, spectral sensitizing dyes are used in combination with the-negative working silver halide emulsions or the internal latent image type direct positive silver halide emulsions. Practical examples of the spectral sensitizing dyes are described in Japanese Patent Application (OPI) Nos. 180550/84, 140335/85, *Research Disclosure*, No. 17029 (1978), U.S. Pat. Nos. 1,846,300, 2,078,233, 2,089,129, 2,156,338, 2,231,658, 2,917,516, 3,352,857, 3,411,916, 2,295,276, 2,481,698, 2,688,545, 2,921,067, 3,282,933, 3,397,060, 3,660,103, 3,335,010, 3,352,680, 3,384,486, 3,623,881, 3,718,470 and 4,025,349.

(3) Structure of Photosensitive Layer

For the reproduction of natural color by the subtractive color process, at least two photosensitive layers, each composed of a silver halide emulsion spectrally sensitized by the aforesaid spectral sensitizing dye and containing the aforesaid dye image-forming material, providing a dye having a selective spectral absorption in the same wavelength range as that of the emulsion. The silver halide emulsion and the dye image-forming material may be formed as separate layers or as one layer as a mixture thereof. When the dye image-forming material has an absorption in the spectral sensitization range of the emulsion associated therewith in the coated state, it is preferred to form the layer of the material separately from the emulsion layer. Also, the silver halide emulsion may be composed of plural emulsion layers (each having different sensitivity) or an optional layer may be formed between the emulsion layer and the layer containing the dye image-forming material. For example, a layer containing a nucleation development accelerator described in Japanese Patent Application (OPI) No. 173541/85 or a partition layer described in Japanese Patent Publication No. 15267/85 may be formed as the optional layer for increasing the color image density, or a reflection layer described in Japanese Patent Application (OPI) No. 91354/85 may be formed for increasing the sensitivity of the photosensitive element.

In a preferred multilayer structure, a blue-sensitive emulsion, a green-sensitive emulsion, and a red-sensitive emulsion are disposed, in that order, from the light exposure side.

Between the emulsion layers may be formed, if necessary, any desired layer. In particular, an interlayer can be formed between the emulsion layers for preventing the development of one emulsion layer from undesirably influencing the other emulsion layers.

When using a developing agent associated with a nondiffusible dye image-forming material, it is preferred that the interlayer contain a nondiffusible reducing agent for preventing the diffusion of the oxidation product of the developing agent. Practical examples of the reducing agent are nondiffusible hydroquinones, sulfonamide phenols, sulfonamide naphthols, etc. Specific examples of these reducing agents are described in Japanese Patent Publication Nos. 21249/75, 23813/75, Japanese Patent Application (OPI) Nos. 106329/74 (U.S. Pat. No. 3,960,570), 129535/74 (U.S. Pat. No. 3,935,016), 24941/82, 21249/83, U.S. Pat. Nos. 2,336,327, 2,360,290, 2,403,721, 2,544,640, 2,732,300, 2,782,659, 2,937,086, 3,637,393, 3,700,453, British Patent No. 557,750, etc. Also, the dispersing methods for these reducing agents are described in Japanese Patent Application (OPI) No. 238831/85 (U.S. Pat. No. 4,619,891) and Japanese Patent Publication No. 18978/85 (U.S. Pat. No. 4,366,236).

When using the compound releasing a diffusible dye by such a silver ion as described in Japanese Patent Publication No. 7576/80, it is preferred that a compound capable of immobilizing the silver ion exist in the interlayer(s).

(G) Processing Composit

The processing composition for use in this invention is uniformly spread on the photosensitive element after exposing the photosensitive element, while completely shielding the photosensitive layer from external light with the light-opaque layer disposed at the back surface of the support or at the opposite side of the photosensitive layer from the side to which the processing composition is applied, to develop the photosensitive layers with a developer contained therein. Generally, the processing composition contains an alkali, a viscosity-increasing agent, a light-opaque agent, a developing agent, a development accelerator or development inhibitor for controlling development, an antioxidant for preventing the deterioration of the developing agent, etc.

The alkali is used to adjust the pH of the processing composition to from about 12 to 14 and examples include alkali metal hydroxides (e.g., sodium hydroxide, potassium hydroxide, lithium hydroxide, etc.), alkali metal phosphates (e.g., potassium phosphate), quanidines, quaternary amine hydroxides (e.g., tetramethyl ammonium hydroxide), etc. Of these materials, potassium hydroxide and sodium hydroxide are particularly preferred. An amount of alkali is 0.1 to 5 mol, preferably 0.3 to 2 mol, per 1 Kg of the processing composition.

The viscosity increasing agent is necessary for uniformly spreading the processing composition and also for maintaining adhesion between the photosensitive layers and the cover sheet when separating the processed photosensitive layers together with the cover sheet.

Examples of the viscosity increasing agent are polyvinyl alcohol, hydroxyethyl cellulose, and metal salts of carboxymethyl cellulose, and preferably hydroxyethyl cellulose and sodium carboxymethyl cellulose. An amount of the viscosity increasing agent is controlled to make a viscosity of the processing composition in 10,000 to 200,000 cps, preferably 30,000 to 150,000 cps, and is varied depending on a type of the viscosity increasing agent. Generally, the viscosity increasing magnet is used in an amount of 5 to 100 g per 1 Kg of processing composition.

As the light-opaque agent, any dyes or pigments, or a combination of them can be used if they do not diffuse into the dye image-forming layer to form stain. A typical light-opaque agent is carbon black, but a combination of titanium white and dye(s) may be used. As the dye, a temporarily light-opaque dye which becomes colorless after a definite time after processing may be used. When a carbon black is used as a light-opaque agent, the carbon black is generally used in an amount of 100 to 400 g per 1 Kg of the processing composition.

As the developing agent, any developing agents which can cross-oxidize the dye image-forming agents that form substantially no stain when they are oxidized can be used. Such developing agents may be used singly or as a mixture thereof, or may be used as a precursor form.

In our invention, a black-and-white developing agent is used as an electron transferring agent as associated with a dye-providing compound capable of releasing a diffusible dye or changing the diffusibility of itself by oxidative reduction.

The developing agent may exist in a proper layer of the photosensitive sheet or in the alkaline processing liquid. Examples include aminophenols and pyrazolidinones, but pyrazolidinones are particularly preferred since they form less stain. Specific examples thereof are 1-phenyl-3-pyrazolidinone, 1-p-tolyl-4,4-dihydroxymethyl-3-pyrazolidinone, 1-(3'-methylphenyl)-4-methyl-4-hydroxymethyl-3-pyrazolidinone, 1-phenyl-4-methyl-4 hydroxymethyl-3-pyrazolidinone, 1-p-tolyl-4-methyl-4-hydroxymethyl-3-pyrazolidinone, etc.

An amount of the developing agent to be used in the present invention is 2 to 50 g, preferably 5 to 30 g per 1 Kg of processing composition.

(H) Cover Sheet and Others

In this invention, a transparent cover sheet is used for uniformly spreading a processing liquid on the photosensitive element. The cover sheet after processing is separated together with the processing liquid and the processed photosensitive layer(s) Accordingly, it is preferred that a surface treatment be applied to the cover sheet or a proper adhesive layer is formed thereon for ensuring sufficient adhesion with the processing liquid. Also, a filter dye may be incorporated in the cover sheet for controlling the sensitivity of the photosensitive layer(s). The filter dye may be directly incorporated in the support for the cover sheet or may be formed as another layer.

Any transparent smooth support conventionally used for photographic light-sensitive materials can be used as the cover sheet in this invention. Examples of the material for the cover sheet are cellulose acetate, polystyrene, polyethylene terephthalate, polycarbonate, etc., and a subbing layer may be formed thereon. A subbing liquid which is used for ordinary photographic light-sensitive materials can be used for the subbing layer in this invention. The cover sheet does not preferably have a layer having a neutralizing function.

The coated white support and cover sheet of this invention are formed into a monosheet film unit using a masking material, a railing material, an excessive liquid trapping material, etc., as described in Japaese Patent Publication No. 33697/73 (U.S. Pat. No. 3,594,164), Japanese Patent Application (OPI) Nos. 43317/73 (U.S. Pat. No. 3,615,436), 153628/75, 11027/77, 48629/81 (U.S. Pat. No. 4,358,523), etc.

In particular, for facilitating the separation after processing, it is effective to form slits as described in Research Disclosure, No. 23026 (1983). The form, depth, etc., of the slit are selected according to the properties of the white support.

The size of the film unit can be optionally selected but the size of commercially available "instant" film and a more compact film size are preferred. For example, a size smaller than the size of FP-100 marketed by Fuji Photo Film Co., Ltd. at present as shown in FIG. 1, or the size shown in FIG. 2 can be used.

For photographing using the film unit of this invention, it is necessary to focus the image of a subject on the film and for this purpose it is convenient to use a mirror in a single-lens reflex instant camera, such as that described in U.S. Pat. No. 3,447,437, etc.

The film unit according to the invention can have an optional adhesive layer or a pressure-sensitive adhesive layer, and preferably an adhesive layer and a releasable sheet, on the back surface of the support of the film unit. It is preferred to previously form a moisture-sensitive type paste layer or a hot melt type adhesive layer, preferably, together with a releasable layer.

The adhesives inclusive of pressure-sensitive adhesive for use in this invention are materials which are previously adhered in a layer on the back surface of the support for the image-receiving material (photosensitive sheet), capable of quickly adhering the image-receiving sheet having photographic images formed thereon to a pasteboard or other mount by pressing, heating, light exposure, application of a solvent, a chemical reaction, etc., with strong adhesion. The fundamental component of the adhesive is a high molecular material capable of giving stronger cohesive force and elasticity. For the purpose, a synthetic polymer or an elastomer is frequently used. Furthermore, a tackifier, i.e., a material giving stickiness is used. Moreover, a softener and a filler are used for controlling the viscosity and the cohesive force of the adhesive to increase the interfacial adhesion between the back surface of the support for the image-receiving layer and the adhesive. Also, for stabilizing the images formed, preventing the discoloring of the adhesive layer, stabilizing the adhesive layer, and for preventing the generation of fungi, an antioxidant, an ultraviolet absorbent, an oxygen intercepting agent, etc., may be used.

Examples of the aforesaid materials are as follows.

Examples of the synthetic polymer or elastomer include polyacrylate, acryl copolymers, vinyl chloridevinyl acetate copolymers, polyvinyl butyral, polyvinyl isobutyral, polyvinyl alcohol, natural rubber, styrene butyrene rubber, butyl rubber, polyisoprene, regenerated rubber, chloroprene, polyisobutylene, silicone rubber, chlorinated rubber, chlorinated butyl, etc.

The tackifier includes, for example, rosin, ester gum, polyolefinic petroleum resins, polyterpene series polymers, coumarone, indene series polymers, styrenic polymers, phenol resins, xylenic polymers, arabic, dextrin, glue, etc.

The softening agent includes, for example, plasticizers for the above-described high molecular materials, polybutene, polyisobutylene low polymers, polyvinyl isobutyl ether low polymers, rosin oil, depolymerized rubber, lanolin, wax, vegetable oils, etc.

Suitable fillers include, for example, titanium oxide, silica, alumina, barium sulfate, starch, clay, polymer fine particle latex, etc.

Antioxidants include, for example, hydroquinones (e.g., 2,5-di-t-butylhydroquinone, etc.), phenols (e.g., 2,6-di-t-butyl-4-methylphenol, 1,1-bis (4-hydroxyphenol)cyclohexane, p-alloxyphenols, bisphenols, hindered phenols, aminophenols, etc.), chromans (e.g., 6-hydroxychromans, 5-hydroxychromans, spirochromans, etc.), gallic acid derivatives, hindered amines, etc.

The stabilizers and antifungal agents include, for example, benzoisothiazoline, isothiazoline, 4thiazoline benzimidazole, halogenated phenol, sulfanylamide, benzotriazole, etc.

The mixture of the above-described components is formed on the back surface of the support in an amount of from about 2 g to 150 g, and preferably from about 5 g to 80 g, per square meter. The mixture can be formed by a method usually employed for adhesive tapes, label papers, free albums, seal prints, etc. For example, the methods described in Japanese Utility Model Application (OPI) No. 41950/85, Japanese Patent Application (OPI) Nos. 23673/86, 60771/86, 83276/86, 103975/86, 148279/86, 148282/86, 174283/86, Japanese Patent Application No. 179559/86, etc., can be used.

For the releasable sheet which is used in this invention, papers, cellophane, films of polyethylene, polypropylene, polyvinyl chloride, triacetyl cellulose, polyethylene terephthalate, etc., synthetic papers, aluminum foils, etc., each subjected to silicone treatment or Teflon working are used. A releasable sheet having an adhesive bond to the adhesive layer weaker than the adhesive bond to the adhesive layer on the back surface of the support for the image-receiving layer is preferably used. For example, a releasable sheet such as a polyalkylene-laminated paper, a polyethylene terephthalate film, an aluminum foil, etc., having a thickness of from about 10 μm to about 300 μm is preferably used.

The back surface of the support for the image-receiving layer may be subjected to corona discharging treatment, electron bombardment, flame treatment, etc., for increasing the bonding strength of the subbing layer and the adhesive layer. If necessary, a subbing layer is formed on the surface of the support for the image-receiving layer and as the material for the subbing layer, a material having good compatibility or affinity with the adhesive and the surface of the support, and preferably a mixture of the material or a graft polymer of the material is used.

On the back surface of the support may be formed a subbing layer, an adhesive layer, and further a releasable sheet. Also, an adhesive layer can first be formed on the surface of a releasable sheet subjected to a silicone treatment or Teflon working, a corona discharging treatment can be applied to the back surface of the support for the image-receiving layer, and then both members may be laminated.

Furthermore, an adhesive layer (1) can be formed on the back surface of the support for the image-receiving layer, an adhesive layer (2) can be formed on a releasable sheet, and then both members may be laminated to form a multilayer structure of the adhesive layers (1) and (2).

A double side coated adhesive tape may be prepared by coating both surfaces of a thin sheet or film with the same or different adhesives, and the adhesive tape may be applied to the back surface of the support for the image-receiving layer together with a releasable sheet.

The back surface of the releasable sheet (i.e., the surface opposite to the surface carrying the adhesive layer) may be matted by coating an inorganic filler so it can be written on.

Since the adhesive layer and releasable sheet in this invention are directly or indirectly brought into contact with the high speed light-sensitive material, materials which fog, desensitize, and stain the light-sensitive materials, and reduce the stability of the light-sensitive materials, should not be used.

Furthermore, in this invention, an adhesive layer without a releasable sheet may be previously formed on the back surface of the image-receiving layer. For the adhesive layer which is previously formed on the back surface of the light-sensitive material, a moisture-sensitive type paste, microencapsulated pressure-sensitive adhesives, or pressure-sensitive adhesives can be used, so that the adhesive layer does not interfere with use of the light-sensitive material, since the adhesive layer has no releasable paper.

The present invention is now described in greater detail with reference to the following examples, but the invention is not to be construed as being limited thereto.

EXAMPLE 1

On one surface of a polyethylene phthalate film support containing titanium white as a white pigment were formed, in succession, a carbon black layer (containing 3.0 g/m$^2$ of carbon black and 4.5 g/m$^2$ of gelatin) and a titanium white layer (containing 3.0 g/m$^2$ of titanium white and 1.0 g/m$^2$ of gelatin) as light-shielding layer.

Then, on the opposite surface of the support from the light-shielding layer were coated, in succession, the following layers to provide a photosensitive sheet.

(1) A neutralizing layer containing 4.0 g/m$^2$ of polyacrylic acid, 4.0 g/m$^2$ of polyvinyl alcohol, and 0.04 g/m$^2$ of 1,4-bis(2,3-epoxypropoxy)butane.

(2) A timing layer containing 6 g/m$^2$ of cellulose acetate having acetylation degree of 55%, and a methyl half ester of a copolymer of methyl vinyl ether and maleic anhydride (1:1 by mol ratio) in a weight ratio of 95:5.

(3) An adhesion strengthening layer containing 0.4 g/m$^2$ of hydroxyethyl methacrylate.

(4) A layer containing 2.5 g/m$^2$ (as total solid components) of a blend (6:4 in solid component weight ratio) of a polymer latex prepared by emulsion polymerizing styrene, butyl acrylate, acrylic acid, and N-methylol acrylic acid amide in a weight ratio of 49.7/42.3/4/4 and a polymer latex prepared by emulsion polymerizing methyl methacrylate, acrylic acid, and N-methylol acrylamide in a weight ratio of 93/3/4.

(5) A mordant layer containing 3 g/m$^2$ of a polymer latex mordant having the following formula and 3 g/m$^2$ of gelatin.

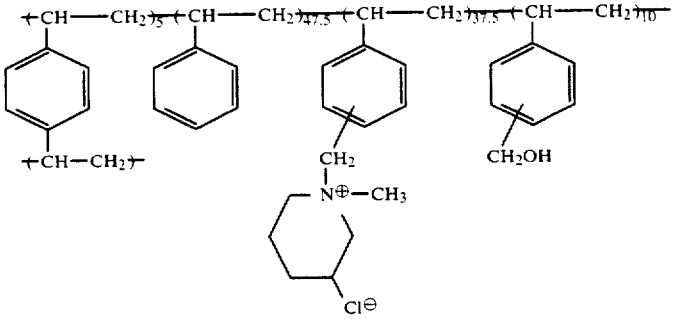

(6) A separating layer containing 0.9 g/m$^2$ of hydroxyethyl cellulose and 0.03 g/m$^2$ of FC-431 (trade name, surface active agent, made by 3M Company).

(7) A layer containing 4 g/m$^2$ of titanium white and 0.6 g/m$^2$ of gelatin.

(8) A layer containing 0.44 g/m$^2$ of a cyan dye-releasing redox compound having the following formula, 0.09 g/m$^2$ of tricyclohexyl phosphate, 0.008 g/m$^2$ of 2,5-di-t-pentadecylhydroquinone, and 0.8 g/m$^2$ of gelatin.

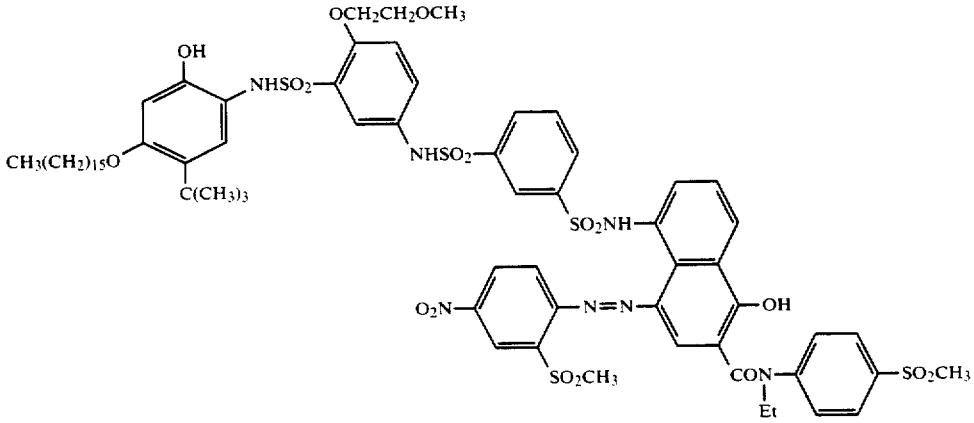

(9) A layer containing 0.5 g/m$^2$ of gelatin.

(10) A red-sensitive emulsion layer containing a red-sensitive internal latent image type direct positive silver bromide emulsion of octahedral grains having a mean grain size of 1.0 μm (0.6 g/m$^2$ as the amount of silver), 1 g/m$^2$ of gelatin, 0.015 mg/m$^2$ of a nucleating agent having the following formula, and 0.06 g/m$^2$ of 2-sulfo-5-n-pentadecylhydroquinone.sodium salt.

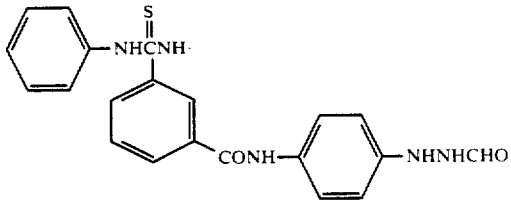

(11) A layer containing 0.43 g/m$^2$ of 2,5-di-tpentadecylhydroquinone, 0.1 g/m$^2$ of trihexyl phosphate, and 0.4 g/m$^2$ of gelatin.

(12) A layer containing 0.5 g/m$^2$ of a magenta dye-releasing redox compound having the following formula, 0.1 g/m$^2$ of tricyclohexyl phosphate, 0.009 g/m$^2$ of 2,5-di-t-pentadecylhydroquinone, and 0.9 g/m$^2$ of gelatin.

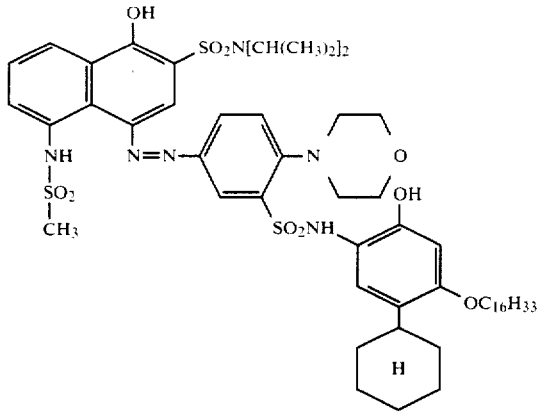

(13) A green-sensitive emulsion layer containing a green-sensitive internal latent image type direct positive emulsion of octahedral grains having a mean grain size of 1.0 μm (0.45 g/m² as the amount of silver), 0.75 g/m² of gelatin, 0.013 mg/m² of the nucleating agent having the same structure as used in Layer (10), and 0.07 g/m² of 2-sulfo-5-n-pentadecylhydroquinone sodium salt.

(14) A layer having the same composition as Layer (11).

(15) A layer containing 0.53 g/m² of a yellow dye-releasing redox compound having the following formula, 0.13 g/m² of tricyclohexyl phosphate, 0.014 g/m² of 2,5-di-t-pentadecylhydroquinone, and 0.7 g/m² of gelatin.

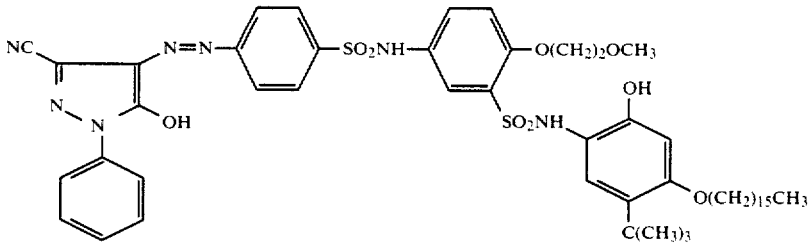

(16) A blue-sensitive emulsion layer containing a blue-sensitive internal latent image type direct positive silver bromide emulsion of octahedral grains having a mean grain size of 1.1 μm (0.6 g/m² as the amount of silver), 1 g/m² of gelatin, 0.019 g/m² of the nucleating agent having the same structure as used in Layer (10), and 0.06 g/m² of 2-sulfo-5-n-pentadecylhydroquinone sodium salt.

(17) An ultraviolet absorption layer containing $4\times10^{-4}$ mol/m² of each of the ultraviolet absorbents having the following structures and 0.5 g/m² of gelatin.

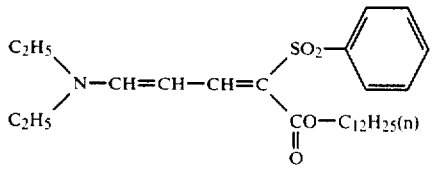

-continued

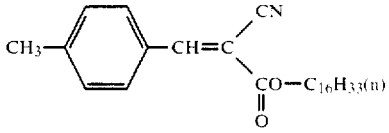

(18) A protective layer containing 1.0 g/m² of gelatin.

Then, an alkaline processing liquid containing a light-shielding agent was prepared as follows and filled in a processing liquid pod.

| Processing Liquid: | |
|---|---|
| 1-m-Tolyl-4-hydroxymethyl-4-methyl-3-pyrazolidone | 10 g |
| 1-Phenyl-4-hydroxymethyl-4-methyl-3-pyrazolidone | 4 g |
| 5-Methylbenzotriazole | 6 g |
| Potassium Sulfite | 8 g |
| Hydroxyethyl Cellulose | 45 g |
| Potassium Hydroxide | 64 g |
| Benzyl Alcohol | 3.4 g |
| Carbon Black Dispersion (35%) | 400 g |
| Water to make | 1 kg |

The photosensitive sheet and the processing liquid pod described above were assembled together with a transparent polyethylene terephthalate film having subbing layer as a cover sheet to form a unitary film as shown in FIG. 1.

Figure 2:
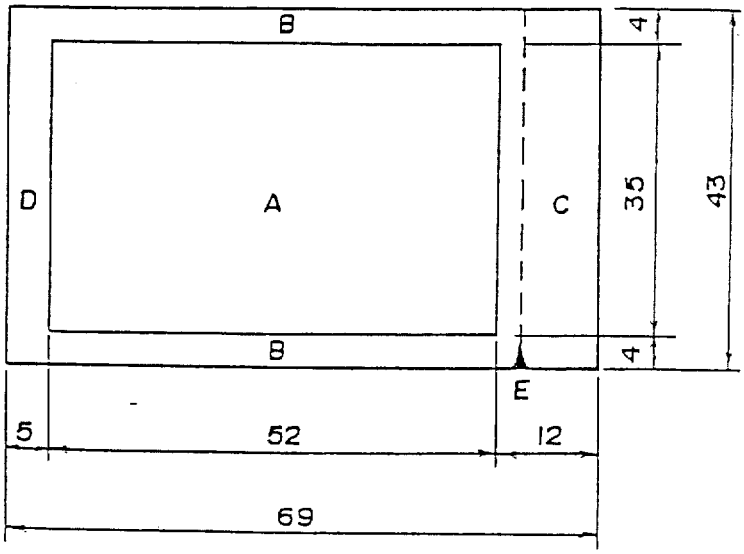
FIG. 2 illustrates the size of another example of the photographic film unit of this invention.

A perforated cutting line E shown in FIGS. 1 and 2 was made in the support at the side containing the processing liquid pod as described in Japanese Patent Application (OPI) No. 67840/81.

After imagewise exposing the film unit through the cover sheet, the film unit was passed through a pair of juxtaposed pressure-applying rollers, whereby the processing liquid in the processing liquid pod was uniformly spread between the photosensitive element and the cover sheet. After 2 minutes or 1 hour, the portion E in FIG. 1 was strongly bent along the cutting line to cut off the portion and at the same time the cover sheet was separated. Thus, the layers (7) and (18) were all easily separated at the separating layer (6) together with the cover sheet and the processing liquid (and liquid pod), regardless of the time for separation (2 minutes or 1 hour since application of the processing liquid) to provide a color print having high quality. The cover sheet thus separated could be easily handled and was not sticky in comparison with a conventional peel-apart type photographic unit.

EXAMPLE 2

On a synthetic paper composed of polypropylene containing titanium white as a white pigment were coated, in succession, the following layers.

(1) A neutralizing layer containing 22 g/m$^2$ of a copolymer of acrylic acid and butyl acrylate (8:2 mol ratio) having a mean molecular weight of 50,000.

(2) A timing layer containing 4.5 g/m$^2$ of cellulose acetate (acetylation degree 51.3%) and a copolymer of styrene and maleic anhydride (1:1 mol ratio, mean molecular ratio about 10,000) at a weight ratio of 95:5.

(3) A layer containing 1.6 g/m$^2$ (as total solid components) of a blend of a polymer latex prepared by emulsion polymerizing styrene, butyl acrylate, acrylic acid, and N-methylol acrylamide (49.7/42.3/4/4 weight ratio) and a polymer latex prepared by emulsion polymerizing methyl methacrylate, acrylic acid, and N-methylol acrylamide (93/3/4 weight ratio) in a solid component weight ratio of 6:4.

(4) A mordant layer having the same composition as Layer (5) of Example 1.

(5) A first separating layer containing 0.4 g/m$^2$ of gelatin.

(6) A second separating layer containing 0.6 g/m$^2$ of hydroxyethyl cellulose.

(7) A light-shielding layer containing 0.5 g/m$^2$ of carbon black.

Over the light-shielding layer were also coated layers having the same compositions as those of Layers (8) to (18) in Example 1.

Also, a cover sheet was prepared by coating 1.0 g/m$^2$ of gelatin on a transparent polyethylene terephthalate film support containing a dye for color correction.

Also, An alkaline processing liquid having the following composition were prepared and filled in a processing liquid pod.

| Processing Liquid: | |
|---|---|
| 1-m-Tolyl-4-hydroxymethyl-4-methyl-3-pyrazolidone | 10 g |
| 1-Phenyl-4-hydroxymethyl-4-methyl-3-pyrazolidone | 5 g |
| 5-Methylbenzotriazole | 6 g |
| Potassium Sulfite | 8 g |
| Carboxymethyl Cellulose Sodium Salt | 58 g |
| Potassium Hydroxide | 64 g |
| Benzyl Alcohol | 3.4 g |
| Carbon Black | 150 g |
| Water | 695 g |

By assembling the aforesaid photosensitive element, cover sheet, and processing liquid pod, a unitary film unit having the dimensions shown in FIG. 2 was prepared.

The film unit was placed in an instantized camera of a type focusing the mirror image of a subject onto the film by means of a mirror and exposed. By the automatic spreading mechanism of the camera, the processing liquid was uniformly spread between the cover sheet and the photosensitive element and at the same time the film unit was released from the camera.

After 90 seconds, the image portion was separated from the pod and cover sheet portions at the cutting line E in FIG. 2 to provide a color print having high image quality, that was substantially not sticky.

EXAMPLE 3

The photosensitive sheet and the alkaline processing liquid as in Example 1 were prepared.

Then, a releasable paper having an adhesive layer was prepared as follows.

For the releasable sheet, a polyethylene terephthalate film 70 μm thick having no harmful photographic properties was treated with a silicone as a releasing agent.

On the both sides of PET film having 12 μm thick was coated an adhesive composition having the following formulation at a thickness of about 5 μm, followed by placing a releasable sheet, to provide a releasable paper with an adhesive layer.

| Adhesive Composition: | |
|---|---|
| 2-Ethylhexyl Acrylate | 80 wt % |
| Methyl Methacrylate | 18 wt % |
| Acrylic Acid | 2 wt % |
| n-Dodecylmercaptan | 0.2 wt % |

The adhesive composition was composed of 95 parts by weight of the above-described components and 5 parts by weight of titanium oxide.

The releasable paper having the adhesive layer described above was laminated on the back surface of the photosensitive sheet and by combining it with the cover sheet and the processing liquid pod as described in Example 1, a unitary type film unit shown in FIG. 1 was prepared.

A perforated cutting line E shown in FIGS. 1 and 2 as described in Japanese Patent Application (OPI) No. 67840/81 was made in the support at the side containing the processing liquid pod.

After imagewise exposing the film unit through the cover sheet, the film unit was passed through a pair of juxtaposed pressure-applying rollers, whereby the processing liquid in the processing liquid pod was uniformly spread between the photosensitive element and the cover sheet.

After 2 minutes or 1 hour, the portion E in FIG. 1 was cut by strongly bending along the cutting line and the cover sheet was separated. Regardless of the separating time (i.e., after 2 minutes or 1 hour had passed), the layer portions (7) to (18) and the processing pod thus used were separated together with the cover sheet at the second separating layer to provide a color print having high image quality. Then, the releasable paper was removed from the back surface of the color print and the color print was easily adhered to a base paper.

EXAMPLE 4

The photosensitive element, cover sheet, and processing liquid pod as in Example 2 were prepared.

Furthermore, the following adhesive compositions (1) and (2) were prepared.

Adhesive Composition (1):

A mixture of 100 parts by weight of a silane-modified ether (MS polymer, made by Kanegafuchi Kagaku Kogyo K.K.), 167 parts by weight of an aqueous 60% toluene solution, and 3 parts by weight of dibutyl tin laurate.

Adhesive Composition (2)

A solution prepared by adding 15 parts by weight of an isocyanate curing agent (Coronate L, trade name, made by Nippon Polyurethane Co.) to a solution prepared by copolymerizing 97 parts by weight of 2-ethylhexyl acrylate and 3 parts by weight of acrylic acid in 150 parts by weight of ethyl acetate to form a copolymer.

The adhesive composition (1) and the adhesive composition (2) described above were coated on opposite surfaces of a paper sheet of about 25 μm in thickness to provide a double surface coated adhesive tape.

The adhesive tape was adhered to a paper sheet both surfaces of which had been coated with polyethylene such that the layer of the adhesive composition (1) was in contact with the releasable sheet disclosed in Example 1 to provide a releasable paper.

The adhesive (2) coated side of the releasable paper was laminated on the back side of the above-described photosensitive element and then the photosensitive element was assembled with the cover sheet and the processing liquid pod to provide a unitary type film unit having the dimension shown in FIG. 2.

The film unit was placed in an instantized camera of the type focusing the mirror image of a subject on a film by a means of a mirror and exposed. By the automatic spreading mechanism of the camera, the processing liquid was uniformly spread between the photosensitive element and the cover sheet and at the same time the film unit was released from the camera.

After 90 seconds, while pressing portion C shown in FIG. 2, the imaged portion was separated from the processed emulsion layers, the processing liquid pod, and the cover sheet at cutting line E in FIG. 2.

Thus, a color photograph having high quality was obtained. The support of the photograph was soft and thin, and by releasing the releasable paper, the photograph was easily adhered to a paper sheet.

EXAMPLE 5

A separation type color diffusion transfer photosensitive element, a processing liquid and a cover sheet were prepared in the same manner as in Example 2.

An adhesive solution was prepared as follows.

| Polymer Composition (1): | |
|---|---|
| Ethyl Acetate | 100 parts |
| 2-Ethylhexyl Acrylate | 60 parts |
| Butyl Acrylate | 33 parts |
| Ethyl Acrylate | 5 parts |
| Acrylic Acid | 2 parts |
| Benzyl Peroxide | 0.12 part |

The polymer composition was prepared by heating the mixture of the above components with stirring to complete the copolymerization followed by cooling.

| Polymer Composition (2): | |
|---|---|
| Carbon Tetrachloride | 150 parts |
| 2-Ethylhexyl Acrylate | 60 parts |
| Bufyl Acrylate | 35 parts |
| Ethyl Acrylate | 5 parts |
| Benzyl Peroxide | 2 parts |

The polymer composition was prepared by heating the mixture of the above components with stirring to complete the copolymerization followed by cooling.

An adhesive solution was obtained by mixing 100 parts of polymer composition (1) and 50 parts of polymer composition (2). The adhesive solution was encapsulated using an aqueous gelatin solution as a dispersion medium to provide adhesive-containing microcapsules.

The microcapsules were coated on the back surface of the photosensitive element and further an aqueous solution of low molecular weight gelatin containing colloidal silica dispersed therein was coated thereon at a thickness of about 0.1 μm. The unitary film unit was prepared using the photosensitive element thus formed.

By imagewise exposing the film unit as shown in FIG. 2, a color photograph was obtained. The photograph was placed on a photographic baseboard laminated with polyethylene and strongly pressed, whereby the photograph was strongly adhered to the photographic baseboard.

As described above, by using the photographic film unit of this invention, a thin color photograph having high image quality, that is not sticky or tacky after removing releasable paper, is obtained by diffusion transfer process. The color print can be handled like ordinary color prints made by conventional photography. Also, the color print obtained can be easily mounted on a baseboard, etc., according to the embodiment of this invention using a film unit having an adhesive layer and releasable paper.

While the invention has been described in detail and with reference to specific embodiments thereof, it will be apparent to one skilled in the art that various changes and modifications can be made therein without departing from the spirit and scope thereof.

What is claimed is:

1. A color diffusion transfer photographic film unit comprising a photosensitive sheet comprising a light-reflective support having disposed thereon in order outwardly from said support (a) a layer having neutralizing function, (b) a dye image-receiving layer, (c) a separating layer and (d) at least one light-sensitive emulsion layer comprising a light-sensitive silver halide, said light-sensitive emulsion layer being associated with a dye image-forming material; a transparent cover sheet superposed on the outermost layer of said photosensitive sheet; and rupturable storage means for providing a developing solution substantially opaque to light between said light-sensitive emulsion layer and said transparent cover sheet; provided that at least one of said light-reflective support and a layer thereon disposed on the side of said light-sensitive emulsion layer opposite said transparent cover sheet is substantially opaque to light, and further provided that a layer which is substantially opaque to light is disposed on the surface of said light-reflective support opposite said light-sensitive emulsion layer.

2. The color diffusion transfer photographic film unit as claimed in claim 1, wherein said photosensitive sheet further comprises a layer substantially opaque to light disposed between said light-sensitive emulsion layer and said light-reflective support.

3. The color diffusion transfer photographic film unit as claimed in claim 1, wherein said light-sensitive emulsion layer comprises a direct positive emulsion comprising silver halide grains capable of forming an internal latent image.

4. The color diffusion transfer photographic film unit as claimed in claim 2, wherein said light-sensitive emulsion layer comprises a direct positive emulsion comprising silver halide grains capable of forming an internal latent image.

5. The color diffusion transfer photographic film unit as claimed in claim 1, wherein said dye image-forming material comprises a negative working dye-releasing redox compound.

6. The color diffusion transfer photographic film unit as claimed in claim 1, wherein said photosensitive sheet comprises an adhesive layer disposed on the side of said light-reflective support opposite said light-sensitive emulsion layer.

7. The color diffusion transfer photographic film unit as claimed in claim 6, wherein said adhesive layer comprises a pressure-sensitive adhesive.

8. The color diffusion transfer photographic film unit as claimed in claim 7, wherein said adhesive layer comprises said pressure-sensitive adhesive in an amount of from about 2 to 150 g per $m^2$ thereof.

9. The color diffusion transfer photographic film unit as claimed in claim 8, wherein said adhesive layer comprises a pressure-sensitive adhesive in an amount of from about 5 to 80 g per $m^2$ thereof.

10. A method for forming an image comprising the steps of:

(a) imagewise exposing to light a light-sensitive emulsion layer of a color diffusion transfer photographic film unit comprising a photosensitive sheet comprising a light-reflective support having disposed thereon in order outwardly from said support (i) a layer having neutralizing function, (ii) a dye image-receiving layer, (iii) a separating layer and (iv) at least one light-sensitive emulsion layer comprising a light-sensitive silver halide, said light-sensitive emulsion layer being associated with a dye image-forming material; a transparent cover sheet superposed on the outermost layer of said photosensitive sheet; and rupturable storage means for providing a developing solution substantially opaque to light between said light-sensitive emulsion layer and said transparent cover sheet; provided that at least one of said light-reflective support and a layer thereon disposed on the side of said light-sensitive emulsion layer opposite said transparent cover sheet is substantially opaque to light, and further provided that a layer which is substantially opaque to light is disposed on the surface of said light-reflective support opposite said light-sensitive emulsion layer;

(b) rupturing said rupturing storage means to provide a layer of said developing solution substantially opaque to light between said light-sensitive emulsion layer and said transparent cover sheet;

(C) developing said light-sensitive emulsion layer to release a diffusible dye image-forming material; and (d) diffusing said diffusible dye to said dye image-receiving layer to form a visible image therein.

11. The method as claimed in claim 10, wherein said photosensitive sheet further comprises a layer substantially opaque to light disposed between said light-sensitive emulsion layer and said light-reflective support.

12. The method as claimed in claim 10, wherein said light-sensitive emulsion layer comprises a direct positive emulsion comprising silver halide grains capable of forming an internal latent image.

13. The method as claimed in claim 11, wherein said light-sensitive emulsion layer comprises a direct positive emulsion comprising silver halide grains capable of forming an internal latent image.

14. The method as claimed in claim 12, wherein said dye image-forming material comprises a negative working dye-releasing redox compound.

15. The method as claimed in claim 10, wherein said photosensitive sheet comprises an adhesive layer disposed on the side of said light-reflective support opposite said light-sensitive emulsion layer.

* * * * *